United States Patent [19]

Panick

[11] Patent Number: 4,611,985

[45] Date of Patent: Sep. 16, 1986

[54] VAPORIZATION BURNER

[75] Inventor: Karl Panick, Planegg, Fed. Rep. of Germany

[73] Assignee: Webasto-Werk W. Baier GmbH & Co., Fed. Rep. of Germany

[21] Appl. No.: 697,848

[22] Filed: Feb. 4, 1985

[30] Foreign Application Priority Data

Feb. 4, 1984 [DE] Fed. Rep. of Germany ..... 3403972

[51] Int. Cl.[4] ..... F23D 11/44

[52] U.S. Cl. ..... 431/240; 126/95; 431/328

[58] Field of Search ..... 431/11, 240, 243, 328, 431/331, 333, 347; 126/95

[56] References Cited

U.S. PATENT DOCUMENTS

| | | | |
|---|---|---|---|
| 2,348,422 | 5/1944 | Schaefer | 431/328 |
| 2,638,160 | 5/1953 | Thomson | 431/333 X |
| 2,680,479 | 6/1954 | Aubert | 431/240 |
| 4,459,805 | 7/1984 | Kamiya et al. | 60/303 |
| 4,530,658 | 7/1985 | Panick | 431/329 |

FOREIGN PATENT DOCUMENTS

| | | | |
|---|---|---|---|
| 938792 | 10/1963 | United Kingdom | 431/333 |

*Primary Examiner*—Samuel Scott
*Assistant Examiner*—Allen J. Flanigan
*Attorney, Agent, or Firm*—Sixbey, Friedman & Leedom

[57] ABSTRACT

A vaporization burner of the type that has a carrier connected with a fuel line on which an absorbent body is located is provided with a heat conducting body for quicker fuel vaporization and for increasing the temperature on the surface of the carrier that faces the combustion chamber. The heat conducting body is formed of a heat resistant and highly heat conductive material and projects into the flame zone of the combustion chamber. The heat conducting body may be attached releasably to the carrier or it may be fastened to it by means of press welding. The heat conducting body may be developed as a hollow body, preferably as a piece of pipe, whereby the end projecting into the flame zone may be open or closed. For closing of the end of the heat conducting body that projects into the flame zone, when the conductive body is formed from a piece of pipe, the free end may be compressed. Furthermore, the heat conducting body may be arranged centrally or eccentrically on the carrier.

20 Claims, 7 Drawing Figures

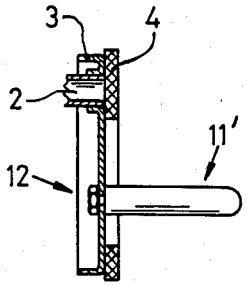
FIG. 2
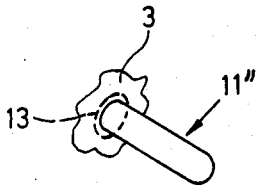
FIG. 3
FIG. 4
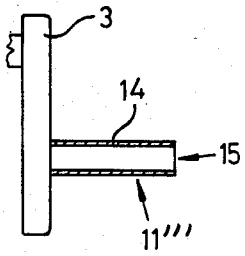
FIG. 5
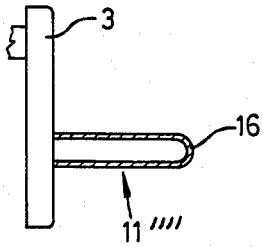
FIG. 6
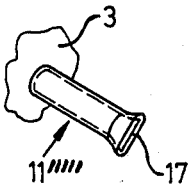
FIG. 7
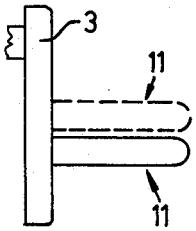

VAPORIZATION BURNER

BACKGROUND AND SUMMARY OF THE INVENTION

The invention relates to a vaporization burner for a heating device such as a heating device for vehicles operated with liquid fuel, especially oil, having combustion chamber within which a carrier connected with a fuel line and receiving an absorbent body is disposed.

Evaporation burners of the initially mentioned type have been known from U.S. Pat. No. 3,531,229 and German Auslegeschrift No. 21 29 663. In these burners, the carrier for the absorbent body is formed directly by one of the front walls of the combustion chamber which, itself, is in heat conducting connection with the outer housing of the burner.

In my co-pending U.S. application Ser. No. 516,381, filed July 22, 1983 now U.S. Pat. No. 4,530,658, a vaporization burner has been described which ensures a quick conversion of the liquid fuel into the vapor form, even in the case of combustion chambers having particularly small dimensions. For this purpose and in the case of this vaporization burner, the carrier in the combustion chamber is supported in a manner that is protected against dissipation of heat therefrom. Preferably, an air cushion is provided between the carrier and the adjacent combustion chamber wall.

In German Auslegeschrift No. 18 03 815, a carbonization insert for burner arrangements for burning liquid fuel is disclosed which is disposed in the combustion chamber. With this arrangement, by an even temperature distribution, carbonization is prevented and a blue burning of the liquid fuel achieved. In this case, the insert is developed as a heating pipe or "heat pipe", that has a metallic jacket which encloses a hollow space tightly on all sides and in which a small quantity of evaporable liquid is located. The liquid which may, for example, be liquid sodium, evaporates during heating and distributes the heat on the entire surface of the heating pipe so that the combustion chamber space, in its entire extent, may be kept at an evenly high temperature. Thus, the temperature at which the undesirable carbonization takes place no longer occurs. Such "heat pipes" have a heat conductive capacity up to 10,000 times the heat conductive capacity of copper. Such a known heat pipe serves, therefore, for a quick carrying off and distribution of heat with the goal of avoiding local hot spots.

In the case of vaporization burners of the initially stated type, it has turned out that the carrier, especially when the heating device operates for a short duration and especially in the case where oil is used as the fuel, the vaporization temperature required for vaporization of the fuel will not always be achieved since, for example, combustion residues deposited on the carrier lead to a thermal isolation of said residues. Also in the case of heating oil and diesel oil, the vaporization temperature range lies in the range of 180° to 350° C., while in the case of gasoline, a vaporization temperate range of 35° to 200° C. suffices.

In order to bring about a solution for the difficulties mentioned previously, the invention has a principal object of creating an evaporation burner of the initially cited type wherein the temperature required for vaporization of the fuel will be reached reliably and quickly independently of any deposit of combustion residues on the carrier, especially in the case of operating the evaporation burner with oil. This object is achieved, in accordance with preferred embodiments of the invention, by providing a heat conducting body of heat resistant, heat conductive material on the carrier in a manner projecting into the flame zone of the combustion chamber.

This heat conducting body on the carrier according to the invention makes it possible for the vaporization burner to operate reliably even in the case of short duration operation of the heating device. Because of its good heat conducting capacity, the heat conducting body conducts the heat from the flame zone of the combustion chamber to the carrier surface and, therefore, makes possible a quick heating up of this surface to the required vaporization temperature which, in the case of operating the vaporization burner with oil, such as heating oil or diesel oil, lies in the range of 180° to 350° C., even if combustion residues have been deposited on the carrier. Furthermore, since the free end of the heat conducting body projects into the flame zone of the combustion chamber, an additional temperature increase occurs at this end as a result of the improvement of the combustion reaction of the fuel/air mixture. Thus, the temperature difference between the surface of the carrier on which the heat conducting body is disposed and the free end of the heat conducting body is relatively great, so that on the basis of this temperature gradient, a very quick heating up of the surface of the carrier with the help of the heat conducting body will be achieved.

In accordance with the invention, various manners of attachment of the heat conducting body to the carrier surface are possible. One very simple attaching method, as far as manufacturing engineering is concerned, is to attach the heat conducting body to the carrier by means of pressure welding. This pressure welding may be carried out in a single operation.

Likewise, in accordance with the preferred embodiments, variations in the construction of the heat conducting body itself, are possible whereby, dependent on the existing conditions of space and in view of the weight of the vaporization burner. For example, the heat conducting body may be developed as a hollow body. In such a case, it is advantageous for the heat conducting body to be closed at one end in order to achieve a distribution of the heat in the area of the flame zone of the combustion chamber over the entire cross sectional surface of the hollow body. A particularly effective manner of closing the free end of the hollow heat conducting body is in such a way that a pointed end will be formed, whereby the walls of the pipe in the area of this pointed end are directly in contact with one another, in order to achieve a heat conduction from this point distributed over the entire wall surface of the hollow body to the carrier surface.

In order to improve the vaporization of the fuel, according to a further feature, the area of the carrier around the heat conducting body is not covered by the absorbent body, so that a fuel film is formed on the exposed surface of the carrier and is vaporized directly from the carrier with the help of the heat conducting body.

In dependence on the constructional conditions of the vaporization burner, it is also contemplated that the heat conducting body may be disposed centrally or eccentrically on the carrier surface. As a result, it is possible for the heat conducting body to be disposed on the carrier in such a way that other features of existing burners such as a glow arrangement and/or additional arrangements, such as a flame monitor or the like, will not have to be restructured or modified to accommodate a carrier with the heat conducting body according to this invention.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 2 shows a detailed view of a section of a carrier with a releasably attached heat conducting body.

FIG. 3 shows a perspective view of a carrier with a heat conducting body that is attached by means of press welding.

FIG. 4 shows a schematic view of a carrier with a heat conducting body in the form of an open-ended hollow body.

FIG. 5 shows a schematic view of a carrier with a heat conducting body in the form of a hollow body that is closed at its forward end.

FIG. 6 shows a schematic view of a carrier with a hollow heat conducting body, the end of which has been closed by having been pressed together.

FIG. 7 shows a schematic view of carrier and heat conducting body illustrating a central or eccentric arrangement of the heat conducting body on the carrier.

DETAILED DESCRIPTION OF THE PREFERRED EMBODIMENTS

Figure 1:
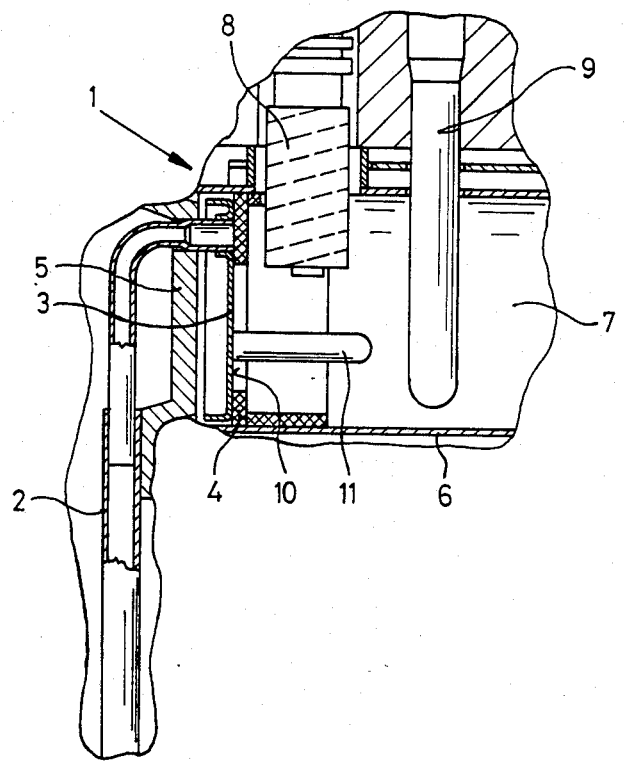
FIG. 1 shows a schematic sectional view of a vaporization burner arranged in a combustion chamber of a heating device.

In FIG. 1, a vaporization burner of a heating device, especially that of a vehicle heating device which has not been shown in detail, is designated generally by numeral 1. A fuel line 2 is connected with a carrier 3 for an absorbent body 4. The fuel line 2 penetrates a lid 5 which serves for the support of the vaporization burner 1 in a combustion chamber 7 defined by a burner pipe 6. An ignition arrangement 8, such as a glow plug, projects into the combustion chamber 7. Furthermore, in FIG. 1, a flame monitor 9, projecting into the combustion chamber 7, is shown. To the extent thus described, the burner corresponds to that of my above-noted earlier application Ser. No. 516,381.

As illustrated, on the surface 10 of the carrier 3, which faces the combustion chamber 7, a heat conducting body 11 is attached which projects into the flame zone of the combustion chamber 7. The heat conducting body 11 consists of a material having good heat resistance and heat conduction properties. The area of the surface 10 of the carrier 3 around the heat conducting body 11 is not covered, as shown, by the absorbent body 4 and lies open. On this exposed area of the surface 10 of the carrier 3, a film develops from the fuel fed in by way of the fuel line 2. The heat conducting body 11, which projects with its free end into the flame zone of the combustion chamber 7, transfers the heat in the flame zone directly to the carrier 3 which, thus, is heated quickly to a high temperature in order to vaporize the fuel film formed. Furthermore, combustion air is introduced into the combustion chamber 7 by way of an unillustrated arrangement (which can be seen by reference to my application Ser. No. 516,381) so that a burner mixture of vaporized fuel and air will be obtained in the combustion chamber.

In the case of the arrangement shown in FIG. 1, the heat conducting body 11 guarantees that the carrier 3 is heated quickly to a high temperature for the vaporization of the fuel, which temperature in the case of oil, for example, may run in the range of 180° to 350° C. Even if combustion residues have formed on the surface 10 of the carrier 3, especially in the open surface area of the surface 10, a quick heating up of the carrier is still ensured.

Further details of the heating device such as a heat transfer arrangement, a combustion air feed-in arrangement and the like, are of the customary type of construction so that a more detailed representation and description of these aspects have been omitted, but again, reference may be had to my U.S. Pat. No. 4,530,1658, for an example of any such unillustrated aspects.

In FIG. 2, a releasable attachment of a heat conducting body 11' on the carrier 3 is indicated schematically in a section view. For the releasable attachment, a screw connection 12 has been shown there as an example. Naturally, other releasable connections of the heat conducting body 11' and the carrier 3 are possible which are quite known per se to those skilled in the art.

While a releasable attachment is possible, permanent means of fixation is preferred for the attachment of a heat conducting body 11'' to the carrier 3, and a pressure welded connection 13, as shown in FIG. 3, being the preferred form of such an attachment.

On the basis of the FIGS. 4–6, effective embodiments of heat conducting bodies 11''', 11'''', 11''''' are shown which are formed as hollow bodies. The attachment of these heat conducting bodies 11''', 11'''' and 11''' to carrier 3 may be carried out as indicated relative to FIGS. 2 and 3.

In FIG. 4, the heat conducting body 11''' is developed in the form of a hollow body which is formed by a piece of pipe 14. The piece of pipe 14 has an open end 15. The heat conducting body 11'''' according to FIG. 5 is likewise developed as a hollow body and has a closed end 16 which projects into the flame zone of the combustion chamber. In the case of the heat conducting body 11''''', shown in FIG. 6 which, similar to that of FIG. 4, is formed from an open-ended piece of pipe 14, has a compressed end 17 that closes the end of the heat conducting body 11''''' which projects into the flame zone of the combustion chamber 7.

In FIG. 7, an eccentric arrangement of the heat conducting body is shown in a solid line and a centrally position arrangement of the heat conducting body 11 on the carrier 3 is shown by a broken line. In this case, the heat conducting body 11 is indicated only schematically and it may be in any of the forms indicated schematically in the FIGS. 3–6. Although it has not been shown in any detail, the heat conducting body 11 may, naturally, also be solid.

Although not shown in more detail in the drawing, not only may the heat conducting body be produced from solid material or from hollow material, but additionally, it may be shaped conically as well as cylindrically, whereby such a heat conducting body may also be encompassed by an absorbent material, such as a fleece.

While we have shown and describe various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

I claim:

1. A pilotless vaporization burner for a heating device operated with liquid fuel, especially oil, such as a heating device for a vehicle, of the type having a combustion chamber in which a glow type ignitor and a carrier are disposed, the carrier being connected with a fuel line and supporting an absorbent body on a surface thereof, wherein a heat conducting body projects from the surface of the carrier, past the ignitor in heat exchange relationship thereto, into a flame zone of the combustion chamber, said heat conducting body being made of a heat conductive material that is capable of withstanding the heat of the flame zone, said conductive body being operative for conducting heat from said glow type ignitor to said carrier so as to rapidly bring said surface thereof to a fuel vaporization temperature during an ignition operation, said conductive body also being operative for conducting heat from the burner flame to said carrier for continuous vaporization of said fuel during combustion.

2. A vaporization burner as in claim 1, wherein the heat conducting body is releasably attached to the carrier.

3. An evaporation burner as in claim 1, wherein the heat conducting body is attached to the carrier by a permanent means of fixation.

4. A vaporization burner as in claim 3, wherein the heat conducting body is attached to the carrier by means of pressure welding.

5. A vaporization burner as in claim 3, that the heat conducting body is a hollow body.

6. A vaporization burner as in claim 5, wherein said hollow body is comprised of a piece of pipe.

7. A vaporization burner as in claim 6, wherein an end of the hollow body, forming said heat conducting body, that projects into the flame zone is open.

8. A vaporization burner as in claim 5, wherein an end of the hollow body, forming the heat conducting body, that projects into the flame zone is closed.

9. A vaporization burner as in claim 8, wherein said closed end of the hollow body is in the form of a compressed end of a tubular body portion.

10. A vaporization burner as in claim 3, wherein an area of the surface of the carrier around the heat conducting body facing the combustion chamber is not covered by the absorbent body.

11. A vaporization burner as in claim 10, wherein the heat conducting body is disposed centrally on the surface of the carrier.

12. A vaporization burner as in claim 10, wherein the heat conducting body is disposed eccentrically on the carrier.

13. A vaporization burner as in claim 1, that the heat conducting body is a hollow body.

14. A vaporization burner as in claim 13, wherein said hollow body is comprised of a piece of pipe.

15. A vaporization burner as in claim 14, wherein an end of the hollow body, forming said heat conducting body, that projects into the flame zone is open.

16. A vaporization burner as in claim 13, wherein an end of the hollow body, forming the heat conducting body, that projects into the flame zone is closed.

17. A vaporization burner as in claim 16, wherein said closed end of the hollow body is in the form of a compressed end of a tubular body portion.

18. A vaporization burner as in claim 1, wherein an area of the surface of the carrier around the heat conducting body facing the combustion chamber is not covered by the absorbent body.

19. A vaporization burner as in claim 18, wherein the heat conducting body is disposed centrally on the surface of the carrier.

20. A vaporization burner as in claim 18, wherein the heat conducting body is disposed eccentrically on the carrier.

* * * * *